United States Patent [19]

Walters

[11] Patent Number: 4,565,454

[45] Date of Patent: Jan. 21, 1986

[54] TIME DISPLAY SYSTEM

[76] Inventor: Richard J. Walters, 396 Victoria Rd., Gladesville, New South Wales 2111, Australia

[21] Appl. No.: 619,049

[22] PCT Filed: Oct. 7, 1983

[86] PCT No.: PCT/AU83/00144

§ 371 Date: Jun. 7, 1984

§ 102(e) Date: Jun. 7, 1984

[87] PCT Pub. No.: WO84/01630

PCT Pub. Date: Apr. 26, 1984

[30] Foreign Application Priority Data

Oct. 7, 1982 [AU] Australia ..... PF6243

[51] Int. Cl.[4] ..... G04C 11/02

[52] U.S. Cl. ..... 368/47; 368/21; 368/204

[58] Field of Search ..... 368/184, 47, 69, 21, 368/204

[56] References Cited

U.S. PATENT DOCUMENTS

| | | | |
|---|---|---|---|
| 4,117,661 | 10/1978 | Bryant, Jr. | 368/47 |
| 4,234,958 | 11/1980 | Pipes et al. | 368/47 |
| 4,270,193 | 5/1981 | Ichikawa | 368/184 |
| 4,300,224 | 11/1981 | Nakazaki et al. | 368/184 |
| 4,308,607 | 12/1981 | Sekiya et al. | 368/184 |
| 4,376,993 | 3/1983 | Freeman | 368/69 |

*Primary Examiner*—Bernard Roskoski
*Attorney, Agent, or Firm*—Ladas & Parry

[57] ABSTRACT

A time display system has a decoder (22) to decode a received time signal indicative of the time at that instant, and controls a time display device (8) to display the time indicated by the time signal. The system also includes means (20) to generate a position signal indicative of the actual time displayed by the display device (8). The decoded time signal and the position signal are compared by a comparator (21) and if they differ, a time adjust signal is generated by time adjustment means (14) to correct the displayed time. Preferably, the time signal is a high frequency signal modulated with time data.

6 Claims, 5 Drawing Figures

TIME DISPLAY SYSTEM

The present invention relates to time display apparatus and in particular to high accuracy time display in situations where a number of displays are required.

BACKGROUND ART

In many situations, a time display is required at various locations around large installations. Often, it is also essential that the time is very accurately displayed at each location. An example of a particular application is the broadcasting industry where the programmes transmitted via a network are often produced in various studios and it is essential that the predetermined time for switching between studios is accurately displayed at all locations.

There are currently two main types of system which are commonly used to provide an accurate time display at a number of locations. The first of these consists of a number of synchronous clocks running from the mains supply and maintaining the time to the accuracy of the frequency of the mains power. In the second commonly used system, the clocks at each location are synchronised to a master clock at a central location. This arrangement necessitates having all the clocks connected via wires to the central distribution centre. Naturally either of these methods can utilize either analogue or digital displays, or a mixture of both.

Unfortunately each of these systems has a number of inherent disadvantages. In the first system, should a blackout occur all the clocks will display the incorrect time at restoration of power and it will be necessary to reset each and every clock. Similarly, at the beginning and end of daylight saving all the clocks must again be corrected by one hour.

The second system can overcome some of the disadvantages inherent in the first, but often the solution is less than satisfactory. In this respect, the "slave" clocks at each location are usually powered from the master and if auxiliary power is available the system will survive a blackout. Adjustment of the clocks at the beginning and end of daylight saving is also possible. Advancement of the clocks is usually effected by advancing the master clock at a rate which the slaves can follow perhaps taking ten minutes to advance the hour. The retardation is often less elegant. Sometimes the master clock is effectively stopped for an hour, thus restoring the correct time.

There are also further problems peculiar to analogue displays, which being mechanical devices are prone to stick, jam, or otherwise misbehave. Accordingly, many mechanical slave clocks utilize a checking mechanism which usually, requires that the hands of the clock are in a certain position at the predetermined checking time. This function is usually effected by having the master output a series of pulses indicative of correct hand position. If the hands of the clock are in the correct position, then these pulses are ignored, but if they are not in the correct position the clock is stepped forward to the correct time.

It will be appreciated that in broadcasting an analogue display incorporating a sweep hand is particularly useful in advising a disc jockey, for example, of the number of seconds remaining before a news bulletin. Digital displays cannot achieve this result as the seconds display moves too quickly to be assimilated.

DISCLOSURE OF INVENTION

It is an object of the present invention to provide a time distribution and display system which will overcome, or substantially ameliorate, the above mentioned disadvantages.

According to one aspect of the present invention there is disclosed a time display system for receiving at spaced instants of time, a time signal indicative of the time at that instant, and for controlling a time display device so as to indicate said time at said instant, said system comprising a decoder to decode said time signal, position means adapted to generate a position signal indicative of the time displayed by said time display device, a comparator means connected to said decoder and said position means to detect the difference, if any, between the time according to said time signal and said displayed time, and time adjustment means to apply a time adjust signal to said time display device to reduce said difference zero.

The time display system is provided with a GMT offset device and a daylight saving offset device connected to the comparator so that the displayed time can be adjusted to differ from the time according to the received time signal. Preferably, the time display system is also provided with a receiving and decoding means connected to the decoder for receiving and decoding a high frequency time signal transmitted with the time data modulating the signal as a high frequency audio signal.

BRIEF DESCRIPTION OF DRAWINGS

Some embodiments of the present invention will now be described with reference to the drawings in which.

BEST MODE OF CARRYING OUT INVENTION

Figure 1:
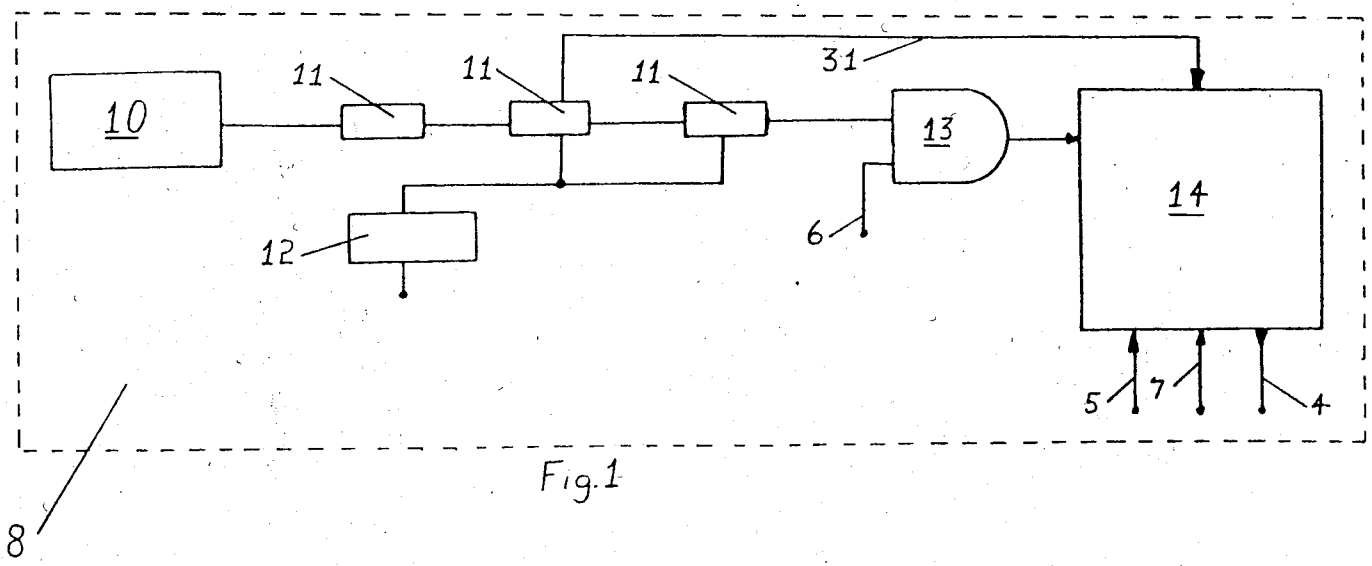
FIG. 1 is a schematic circuit diagram of an ánalogue clock forming part of the time display system of a first embodiment.
Figure 2:
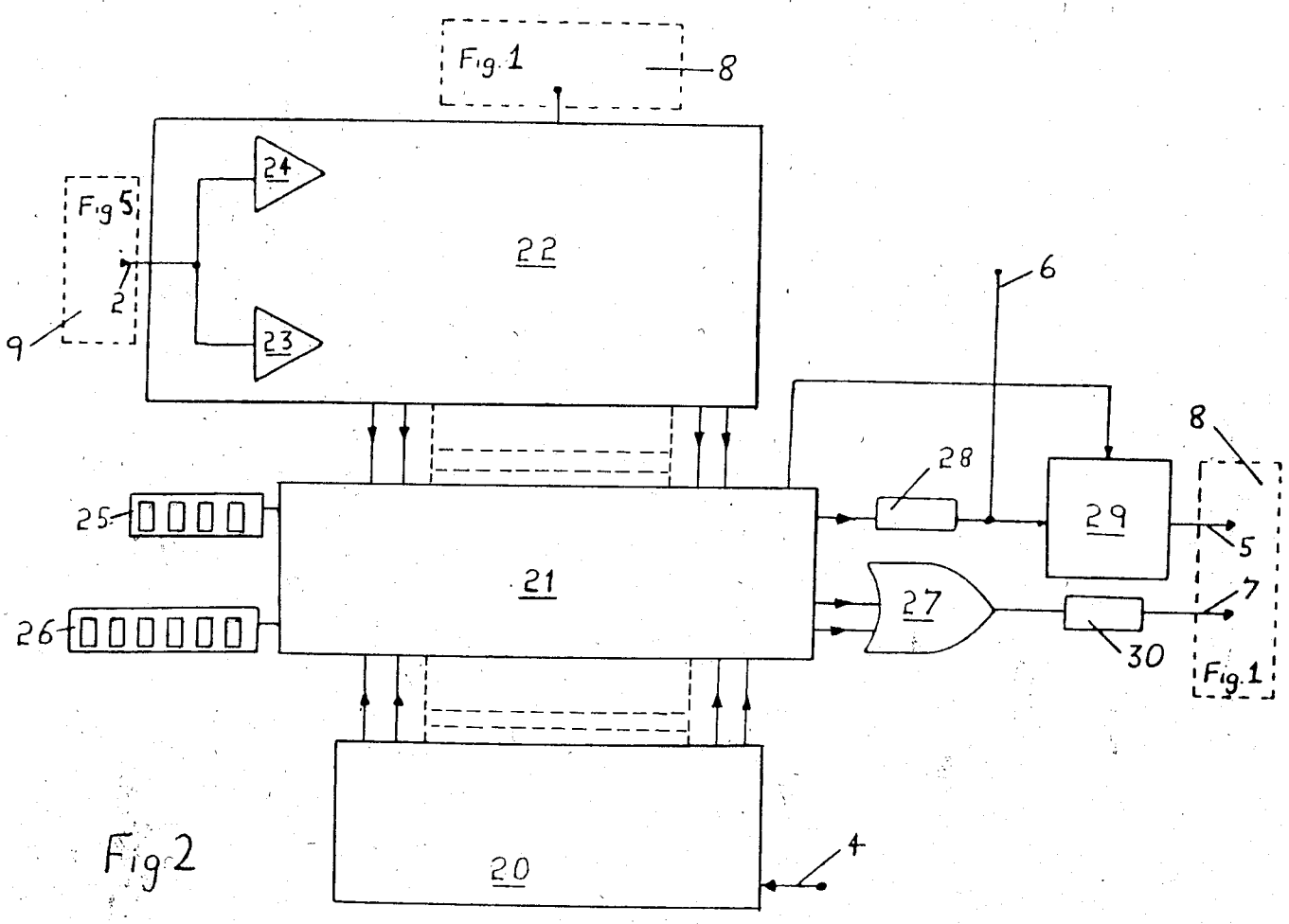
FIG. 2 is a schematic circuit diagram showing the arrangement of the decoder, comparator, encoder, time adjustment means, GMT offset device, and the daylight saving offset device forming part of the time display system of a first embodiment.

As seen in FIGS. 1 and 2, the time display system of the first embodiment comprises a time signal decoder 22 which decodes an incoming time signal, and transmits the time information to a comparator 21. An encoder 20 which encodes and transmits to the comparator 21, time information received from a time display 8 (FIG. 1), is also connected to the comparator 21. The comparator 21 is also connected via a delay 28, a voltage to frequency converter 29 and a line 5 to a motor driver 14 (FIG. 1) for a substantially conventional analogue clock having an hour hand, a minute hand and a second or sweep hand (not illustrated), the motor driver 14 forming part of the time display 8 (FIG. 1). A line 6 also connects the delay 28 to the motor driver 14 (FIG. 1)

via an AND gate 13 (FIG. 1) forming part of the time display 8 (FIG. 1). The comparator 21 is further connected via an OR gate 27, a delay 30 and a line 7 to the motor driver 14 (FIG. 1), and a line 4 connects the motor driver 14 (FIG. 1) to the encoder 20.

The time display 8 (FIG. 1) further comprises a reference oscillator 10 connected via three frequency dividers 11 and the AND gate 13 to the motor driver 14. The motor driver 14 is also connected to one of the frequency dividers 11 via a line 31 and two of the frequency dividers 11 are connected via a synchronising unit 12 to the decoder 22 (FIG. 2).

A GMT offset device 26 and a daylight saving offset device 25 are also connected to the comparator 21.

The operation of the time display system of the first embodiment is as follows.

As seen in FIGS. 1 and 2 the motor driver 14 receives a 2 Hz signal produced by passing a 2 MHz signal from the reference oscillator 10 through the three frequency dividers 11. A 2 Hz signal is also supplied to the motor driver 14 from the appropriate frequency divider 11 to toggle the motor driver 14 direction to ensure the next step pulse will drive the clock in the forward direction. The synchronising unit 12 is also connected to two of the frequency dividers 11 and to the decoder 22 to allow synchronisation of the 2 Hz reference signal with the time code. The motor driver 14 accepts either the 2 Hz reference signal or the output of the voltage to frequency converter 29, and generates a two phase driver signal. In addition, the motor driver 14 transmits position data via the line 4 to the clock encoder 20.

The position data received by the encoder 20 from the motor drive 14 is encoded and stored in the encoder 20. The decoder 22 receives a time code signal via input 2, decodes and separates the signal into data and clock portions and amplifies these portions via amplifiers 24 and 23 respectively. The clock portion is used to synchronise the internal divider (not illustrated) of the decoder 22 and the reference oscillator 10 to the time code. The decoder 22 transforms the data portion into parallel binary coded decimal (BCD) and transmits this information to the comparator 21.

The comparator 21 compares the BCD encoded time according to the signal received from the decoder 22 with the time according to the signal received from the encoder 20. If the time according to each source is the same, the motor driver 14 will continue to generate a two phase driver signal in accordance with the 2 Hz reference signal. If the time according to the signal received from the decoder 22 differs from the time according to the signal received from the encoder 20, the comparator 21 will transmit an output via the delay 28 to the voltage to frequency converter 29 and the AND gate 13 via the line 6.

Upon receipt of this output the AND gate 13 will inhibit the 2 Hz signal to the motor driver 14. The output reaching the voltage to frequency converter 29 will cause the production of an AC signal having a variable frequency. The frequency is initially increased from zero to a predetermined maximum frequency corresponding to the maximum stepping rate of the clock. This predetermined frequency is maintained for a period and then decreased as the correct time is approached. This AC signal is transmitted to the motor driver 14. The purpose of the delay 28 is to prevent the motor driver from oscillating because of the apparent difference in the time according to the encoder 20 from the time according to the decoder 22 at the instant before the motor driver 14 emits a pulse.

On receipt of an AC signal via line 6, the motor driver 14 steps the analogue clock (not illustrated) at a rate corresponding to the frequency of the AC signal until the time according to the signal received at the comparator from the encoder 20 is equal to the time according to the signal received from the decoder 22. The direction in which the motor driver 14 steps the clock is determined by the comparator 21 which, in the event that the time according to the signal received from the decoder 22 is greater than or equal to the time according to the signal received from the encoder 20, transmits an output via the OR gate 27, the delay 30, and the line 7 to the motor driver 14. The presence of this signal at the motor driver 14 ensures that the clock steps in the forward direction whilst the absence of a signal ensures that the clock steps in the reverse direction. Again the delay 30 is included to prevent any oscillation in the displayed time at the instant before the motor driver emits a pulse.

Preferably, the voltage to frequency converter 29 includes a ramp device (not illustrated) which ensures that the frequency of the AC signal produced is increased and is then decreased as the time error signal from the delay 28 decreases in magnitude. In operation the ramp device allows the frequency of the AC signal produced by the voltage to frequency converter 29 to progressively increase to a maximum but when the time error signal from the delay 28 decreases to below a predetermined level, the frequency of the AC signal produced by the voltage to frequency converter 29 is rapidly reduced. The operation of this ramp device therefore prevents any excessive stress being imposed upon the mechanical elements of the system through sudden starting and stopping. A further preferred feature in the form of a rechargeable battery to provide auxiliary power for the internal timing circuits can also be incorporated into the above described first embodiment so that in the event of a power failure, the time display system continues to function.

Figure 3:
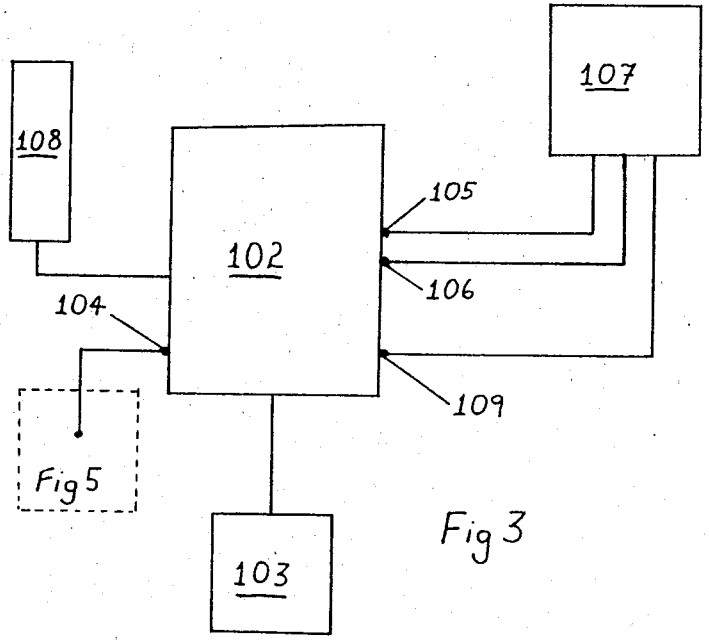
FIG. 3 is a schematic circuit diagram of a processing unit, motor driver, reference frequency oscillator, and adjustable offset device forming part of the time display system of a second embodiment.

As seen in FIG. 3, the time display system of the second embodiment comprises a processing unit 102 connected to a reference oscillator 103. The processing unit 102 has an input 104 to receive a time signal and is connected via driving outputs 105, 106 to a motor driver 107 for a substantially conventional analogue clock having an hour hand, minute hand and a second or sweep hands (not illustrated). A further connection is provided between a controlling output 109 of the processing unit 102 and the motor driver 107.

The operation of the time display system of the second embodiment is as follows.

As seen in FIG. 3, a 2.4576 mega-hertz reference frequency signal is received by the processing unit 102 from the reference frequency oscillator 103 and is frequency divided to produce a 2 hertz pulsed signal. The 2 hertz pulsed signal is transmitted via driving outputs 105, 106 to the motor driver 107 for a substantially conventional analogue clock (not illustrated). The motor driver 107 operates the analogue clock (not illustrated) in a substantially conventional manner so as to adjust the time displayed by the analogue clock (not illustrated) according to the pulses received from the processing unit 102.

The number of pulses transmitted from the processing unit 102 to the motor driver 107 is stored by the processing unit 102 and used to determine the time indicated by the analogue clock (not illustrated) at any instant.

The time code signal received via input 104 is decoded by the processing unit 102 and the time according to the time signal is obtained. This time according to the time signal is compared by the processing unit 102 with the time determined from the number of stored pulses and the difference, if any, detected. The detected difference is reduced to zero by the processing unit 102 transmitting pulses via driving outputs 105, 106 to motor driver 107 so as to adjust the time displayed by the analogue clock (not illustrated) to conform with the time according to the received time code. In the event that a time code signal is not received by the processing unit 102, no adjustment to the time displayed by the analogue clock (not illustrated) is made.

Preferably, the processing unit 102 is a Motorola (registered trade mark) MC146805E2 microprocessor.

In addition, the processing unit 102 can be connected to an adjustable offset device 108 which can be adjusted according to a desired difference between the time according to the time code signal and the time displayed by the analogue clock (not illustrated). The desired difference can correspond to the time difference resulting from daylight saving or can be used to offset the time displayed from a standard time according to the time code signal, for example, Greenwich Mean Time.

The adjustable offset device 108 transmits a signal or series of signals to the processing unit 102 which are indicative of the desired offset and the processing unit 102 uses the signal or series of signals to determine the correct offset between the time according to the time code signal and the time displayed by the analogue clock (not illustrated).

Figure 4:
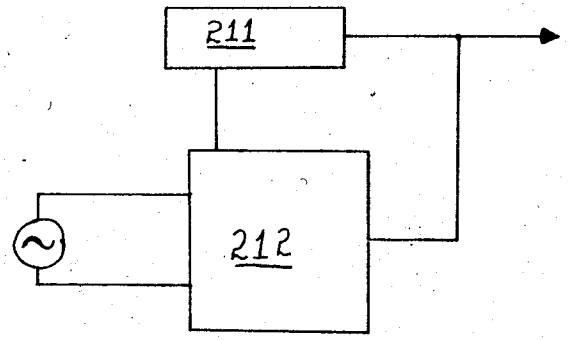
FIG. 4 is a schematic circuit diagram of a rechargeable battery and a power supply forming part of the time display system of a second embodiment.

As seen in FIG. 4 a rechargeable battery 211 and a power supply 212 can also be incorporated into the above described second embodiment. The rechargeable battery 211 provides power to the time display system in the event of a mains power failure and the power supply 212 includes a low voltage sensor (not illustrated) which monitors the state of charge of the battery during battery operation of the time display system. In the event that the voltage of the battery 211 drops below a predetermined level the low voltage sensor (not illustrated) signals the processing unit 102 which responds by storing the time displayed by the analogue clock (not illustrated) at that instant and going into a "standby mode". In this "standby mode" the processing unit 102 does not transmit any signals via driving outputs 105, 106 and therefore the system consumes a smaller amount of power. When power is restored the processing unit 102 compares the time displayed by the analogue clock (not illustrated) at the instant the low voltage signal was received with the time according to the received time code signal and transmits the correct number of pulses via driving outputs 105, 106 to adjust the analogue clock (not illustrated) to display the correct time.

The power supply can further include a mains sensor (not illustrated) which detects a mains power failure and transmits a signal to the processing unit 102. Upon receipt of this mains failure signal the processing unit 102 transmits an output via controlling output 109 to the motor driver 107. The motor driver 107 responds to the presence of this controlling signal by limiting the speed at which the analogue clock (not illustrated) can be adjusted to a predetermined maximum. In this way power consumption during battery operation of the time display system is reduced and battery life extended.

Preferably the time code used by the time display system is an Inter Range Instrumentation Group (IRIG) code.

Figure 5:
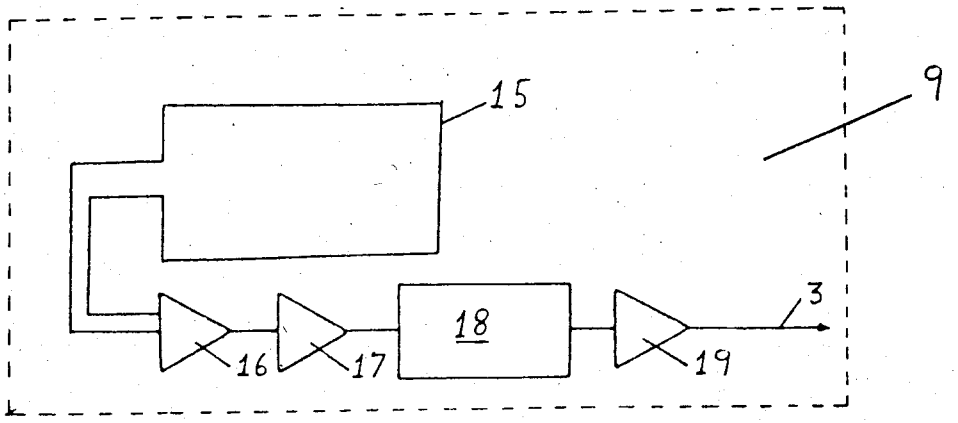
FIG. 5 is a schematic circuit diagram of a phase locked loop receiver and decoder for use with the time display systems of the first or second embodiments.

The time code signal transmitted to the decoder 22 via input 2 in the first embodiment and the input 104 of the second embodiment can be provided by a phase locked loop receiver and decoder 9 as shown in FIG. 5. As seen in FIG. 5, the phase locked loop receiver and decoder consists of a pickup loop 15, a linear amplifier 16, a limiting amplifier 17, a phase locked loop decoder 18, a second linear amplifier 19, and an output line 3. In operation, the phase locked loop receiver and decoder 9 receives a signal transmitted from an external source by means of the pickup loop 15. The linear amplifier 16 amplifies the received signal whilst the limiting amplifier 17 limits the amplitude of the signal and removes any amplitude modulation. The phase locked loop decoder 18 decodes the received signal and the second linear amplifier 19 amplifies the decoder signal to a suitable level to drive the decoder 22 (FIG. 2) via the line 3.

The foregoing describes only some embodiments of the present invention and modifications, obvious to those skilled in the art, may be made thereto without departing from the present invention.

I claim:

1. A time display system for receiving at spaced instants of time, a time signal indicative of the time at that instant, and for controlling an analogue time display device having hands operable by a motor so as to indicate said time at said instant, said system comprising a decoder to said time signal, a position means adapted to generate a position signal indicative of the time displayed by said time display device, a comparator means connected to said decoder and said position means to detect the difference, if any, between the time according to said time signal and said displayed time, first offset means connected to said comparator means to provide a first predetermined offset between the time according to said time signal and said displayed time whereby said displayed time corresponds to a time zone determined by said first offset, and a second offset means connected to said comparator means to provide a second offset at a predetermined time whereby said displayed time is corrected for any daylight saving in said time zone, and time adjustment means to apply a time adjust signal to said time display device to reduce said difference to zero and apply said first and second offsets, said time adjust signal having an initial and a final portion in which the rate of time adjustment of said time display device is slowed from a maximum rate corresponding to that portion of said time adjust signal intermediate said initial and final portions.

2. A system as claimed in claim 1 wherein said time signal comprises a high frequency signal modulated with a high frequency audio signal carrying the time data and wherein said decoder includes a receiving means adapted to receive and demodulate said high frequency signal.

3. A system as claimed in claim 2 wherein said signal is modulated with time data according to Inter Range Instrumentation Group (IRIG) code.

4. A system as claimed in claim 1 wherein said display system is powered by a mains supply and wherein said display system includes a rechargeable auxiliary power supply and recharging means connected thereto, said auxiliary power supply being adapted to supply the full power requirement of said display system for a minimum predetermined period in the event of a mains power failure.

5. A system as claimed in claim 1 wherein said decoder, said position means, said comparator means and said time adjustment means are incorporated within a single microprocessor chip.

6. A system as claimed in claim 4 wherein said rechargeable auxiliary power supply includes a low voltage sensing means connected to said microprocessor and adapted to transmit a low voltage signal to said microprocessor if the voltage of said rechargeable auxiliary power supply falls below a predetermined value and wherein said microprocessor is adapted to switch to a standby mode on receipt of said low voltage signal.

* * * * *